United States Patent [19]

Slaughter et al.

[11] Patent Number: 4,576,235

[45] Date of Patent: Mar. 18, 1986

[54] DOWNHOLE RELIEF VALVE

[75] Inventors: William B. Slaughter, Angleton; Henry C. Haynie, Sr., Houston, both of Tex.

[73] Assignee: S & B Engineers, Houston, Tex.

[21] Appl. No.: 537,969

[22] Filed: Sep. 30, 1983

[51] Int. Cl.[4] ..... E21B 34/10; E21B 34/08

[52] U.S. Cl. ..... 166/374; 166/317; 166/321

[58] Field of Search ..... 166/317, 319, 321, 325, 166/332, 374; 137/528, 469

[56] References Cited

U.S. PATENT DOCUMENTS

| | | | |
|---|---|---|---|
| 1,754,641 | 4/1930 | Mobley | 137/528 |
| 2,798,561 | 7/1957 | True | 166/321 |
| 3,078,923 | 2/1963 | Tausch | 166/321 |
| 3,583,481 | 6/1971 | Vernotzy | 166/321 |
| 3,662,834 | 5/1972 | Young | 166/374 |
| 3,782,461 | 1/1974 | Watkins | 166/72 |
| 3,847,223 | 11/1974 | Scott et al. | 166/305 R |
| 3,986,554 | 10/1976 | Nutter | 166/319 |
| 4,059,157 | 11/1977 | Crowe | 166/317 |
| 4,109,725 | 8/1978 | Williamson et al. | 166/315 |
| 4,161,219 | 7/1979 | Pringle | 166/324 |
| 4,252,197 | 2/1981 | Pringle | 166/322 |
| 4,280,561 | 7/1981 | Fredd | 166/332 |
| 4,361,188 | 11/1982 | Russell | 166/381 |
| 4,428,428 | 1/1984 | Smyrl et al. | 166/319 |

OTHER PUBLICATIONS

World Oil, Composite Catalog of Oilfield Equipment and Services, 1980–1981, pp. 766–784, 1359–1367, 726–727, 882, 1404.

*Primary Examiner*—Stephen J. Novosad
*Assistant Examiner*—Michael Goodwin
*Attorney, Agent, or Firm*—Anastassios Triantaphyllis; David A. Rose

[57] ABSTRACT

A downhole relief valve connected to a tubing string in a producing well above the packer for controlling the well to prevent excess pressure built up in the annulus and casing damage following a tubing rupture at a point where the flowbore pressure exceeds the annulus pressure. The valve has a housing, fluid communication means between the flowbore and the annulus and a piston mounted within the housing for reciprocating between an open position and a closed position to allow flow in the fluid communication means between the flowbore and the annulus. The piston is biased to the closed position by compressed gas and/or a shear pin and to the open position by the hydraulic force exerted by the fluids from the casing annulus. If the hydraulic force exerted by the fluids from the casing annulus exceeds the forces biasing the piston to the closed position, the piston moves to the open position and fluid from the casing annulus flows into the flow bore and kills the well. A method for controlling a producing well using the downhole relief valve is disclosed.

27 Claims, 5 Drawing Figures

DOWNHOLE RELIEF VALVE

TECHNICAL FIELD

This invention relates to well tools for the production of hydrocarbons in an oil and gas well and more particularly to downhole safety valves for controlling the well in case of a rupture in the production tubing.

BACKGROUND OF THE ART

In a typical hydrocarbon producing well, a production tubing extends downwardly into the cased borehole and through the formation being produced. A packer, disposed on the production tubing above the formation, seals the lower borehole annulus. The upper borehole annulus, formed between the production tubing and cased borehole, is filled with well fluids, such as drilling mud, creating a static head above the packer to maintain control of the well. Hydrocarbons from the formation flow into the flowbore of the production tubing, via a perforated nipple as for example, to the surface.

In certain circumstances the production tubing above the packer may rupture. The rupture might occur, for example, because of a structural weakness in the production tubing. Such a weakness may be caused by corrosion combined with the production pressures from the hydrocarbons flowing through the flowbore of the production tubing.

If the rupture occurs at a point in the production tubing where the pressure of the upper borehole annulus immediately external of this point is greater than the production tubing flowbore pressure immediately internal of this point and therefore a pressure differential exists, drilling fluids from the upper annulus will tend to flow through the rupture and into the production tubing thereby killing the well. If the rupture occurs at a point in the production tubing where the static head pressure in the upper borehole annulus is less than the formation pressure in the production tubing flowbore, a pressure differential exists and the hydrocarbons in the production tubing will tend to flow through the rupture in the production tubing and into the upper borehole annulus. Thus, the pressure in the upper borehole annulus is increased and additional pressure is applied to the interior of the casing. Should the casing in the cased borehole have insufficient structural strength to withstand the increased pressure, the casing will rupture. The rupture potential in the casing is greatest when the rupture in the production tubing occurs near the surface where the static head pressure is at a minimum and the pressure differential is at a maximum. Further the differential external pressure on the casing is greater near the surface.

The problem may occur in either an oil well or a gas well. In an oil well, the pressure will increase due to the additional hydraulic head created by the leaking hydrocarbon liquid and/or gas. The gas mixed with the oil forms a gas pocket at the top of the upper casing annulus. In a gas well, the pressure will increase due to the gas pocket formed at the top of the upper casing annulus caused by the gas leaking from the flowbore into the upper casing annulus.

The consequences of a casing rupture and/or a well head blowout may be numerous and costly. Such a blowout may cause severe injuries to people present in the vicinity of the well. It may also cause severe material damage to the well and any other property adjacent to it. Furthermore, other economic losses will be sustained due to the loss of gas sales, equipment replacement, repair services, etc.

Downhole safety valves, disposed in the flowbore of the production tubing for the control of hydrocarbon flow therethrough, are well known. See for example the safety valves manufactured by Baker International, Inc. and Camco, Inc. disclosed in the 1980–81 *Composite Catalog of Oil Field Equipment and Services,* Volume 1 at pages 766–784 and 1359–1367, respectively. Other safety valves are disclosed in U.S. Pat. Nos. 2,798,561; 3,078,923; 3,782,461; 3,847,223; 4,161,219; 4,252,197; and 4,361,188. If it becomes necessary to kill the well and hydraulic control is lost, the safety valve can be closed from the surface to prevent flow through the production tubing.

One difficulty with many of the prior art safety valves is the requirement that they be actuated from the surface by the rig operator and are not automatically actuated when the need to close the production tubing flowbore arises and before extensive damage is done. Safety valve systems that require actuation of the valve by the rig operator are disclosed in U.S. Pat. Nos. 2,798,561; 3,078,923; 3,782,461; 3,847,223; 4,161,219; 4,252,197; and 4,361,188.

Another disadvantage in safety valves actuated from the surface is that the actuation is done through hydraulic lines extending from the surface and to the valve through the annulus. Such lines are exposed to the well fluids in the annulus and consequently high pressure and corrosive conditions. Therefore, they are susceptible to mechanical failure and frequent repair requirements. Furthermore, they contribute to the complexity of the operation due to equipment crowding and space occupancy in the well and in the annulus. Safety valve systems having hydraulic lines extending to the surface are shown in U.S. Pat. Nos. 2,798,561; 3,078,923; 3,782,461; 4,252,197.

Many prior art safety valves for closing the production tubing flowbore have certain disadvantages associated with the location of the valves. They may hydraulically restrict the flow of hydrocarbons in the flowbore. They may impede the usage of fishing tools lowered into the well for tool retrieval or other operations. Also, they may sustain mechanical damage caused by corrosion and vibration because of their continuous exposure to high pressure hydrocarbons flowing to the surface. Furthermore, once in the closed position they may fail due to the high pressure exerted directly beneath them.

Various methods are used to actuate downhole safety valves. U.S. Pat. Nos. 2,798,561; 3,078,923; 3,782,461; 4,161,219; 4,252,198; and 4,361,188 disclose applying hydraulic pressure on a sliding piston which, when reciprocated by hydraulic pressure, moves to actuate the safety valve. As disclosed in U.S. Pat. No. 4,361,188, such a sliding piston has a portion thereof exposed to annulus pressure and is reciprocated upon a predetermined increase in annulus pressure.

The prior art discloses means for biasing such a sliding piston in the normal position. The normal position generally being the position of the piston while the valve is closed. Various biasing means have been used such as a spring in U.S. Pat. Nos. 2,798,561 and 3,078,923, a compressible pressurized fluid in U.S. Pat. Nos. 3,782,461 and 4,161,219, or a combination of these in U.S. Pat. Nos. 3,782,461 and 4,161,219.

U.S. Pat. No. 4,361,188 discloses a well apparatus with a pressure accumulator for operating a safety valve. The pressure accumulator is charged downhole to the normal annulus pressure caused by the fluid static head and provides biasing means for maintaining the safety valve to an open position so long as the annulus pressure remains normal. Should a leak occur in the tubing or the packer causing the downhole annulus pressure to increase, the biasing force supplied by the pressure accumulator is overcome and the well apparatus closes the safety valve.

U.S. Pat. No. 4,161,219 discloses reducing the piston area exposed to hydraulic pressure to reduce the force required by the means to bias the piston in the normal position against the hydraulic pressure.

U.S. Pat. No. 4,109,725 discloses well apparatus for opening a circulation valve to provide fluid communication between the interior of a tubing string and the annulus for use in testing the well. Such valve is powered by a sliding piston which is biased by a spring to a position closing the valve and displaced to a position opening the valve by a force caused by pressure in the annulus around the apparatus.

It is well known to use sliding sleeves as a downhole flow control device mounted in the production tubing to control flow between the tubing and the casing annulus. Such sliding sleeves are shown in Volume 1 of the 1980–81 *Composite Catalog of Oil Field Equipment and Services* at pages 726–7, 882 manufactured by Baker International, Inc. and at page 1404 manufactured by Camco, Inc. These sleeves are operated by wirelines.

Such sleeves have many applications. They may be used for circulating purposes, killing a well, spotting acid or equalizing pressure between an isolated formation and tubing string.

U.S. Pat. No. 3,662,834 discloses a sliding valve for controlling flow between the tubing and casing annulus for various treating operations such as acidizing, fracturing, or sandconsolidating operations. A sliding sleeve is held in the normal position on the valve closing ports communicating the tubing with the casing annulus. To actuate the sleeve, a tubing plug is lowered into the valve body to close the flowbore of the tubing. The tubing is pressurized to apply pressure to one end of the sliding sleeve to shear pins holding the sleeve in the normal position and move the sleeve to the open position.

The prior art sliding sleeves are used prior to producing the well. Many sleeves require lowering a tool through the production tubing to actuate the sleeve to open flow between the tubing and casing annulus. Such tool cannot be lowered into production tubing while the well is producing since such a tool would be blown out of the well by the high formation pressure. Furthermore, such actuation from the surface would be manual and not automatic. Another drawback of such sleeves is that they are exposed directly to annulus fluids and therefore are susceptible to corrosion, fouling and mechanical stress and subsequent failure.

These and various other objects and advantages of the present invention will become readily apparent to those skilled in the art upon reading the following detailed description and claims and by referring to the accompanying drawings.

The above objects are attained in accordance with the present invention by the provision of a method of killing the well due to a rupture in the production tubing and for use with apparatus fabricated in a manner substantially as described in the above abstract and summary.

SUMMARY OF THE INVENTION

The method and apparatus of the present invention includes a downhole relief valve series connected in the production tubing above the packer. The downhole relief valve includes a tubular body formed by an inner tubular mandrel disposed within an outer tubular member. The inner mandrel has a flow passage therethrough coaxial with the flowbore of the production tubing. The inner mandrel and outer member form an annular chamber therebetween. Ports in the inner mandrel provide communication between the flow passage and chamber. A piston is reciprocably mounted within the chamber having one end thereof exposed to the casing annulus pressure through apertures in the outer member. Compressed gas in the chamber and/or a shear pin hold the piston in the closed position against the casing annulus pressure. Should the casing annulus pressure exert a force on the piston which exceeds the force applied by the chamber pressure, the piston will move to the open position opening the ports and permitting the flow of well fluids from the casing annulus through the apertures and ports and into the flowbore of the production tubing.

Accordingly, should the production tubing rupture thereby increasing the casing annulus pressure on the piston so as to overcome the chamber pressure, the downhole relief valve will open and allow the well fluids from the casing annulus to create a static head in the production tubing and kill the well.

Other objects and advantages of the invention will appear from the following description.

BRIEF DESCRIPTION OF THE DRAWINGS

For a detailed description of the embodiments of the apparatus and method of the present invention, reference will now be made to the accompanying drawings wherein.

DESCRIPTION OF THE PREFERRED EMBODIMENTS

Figure 1:
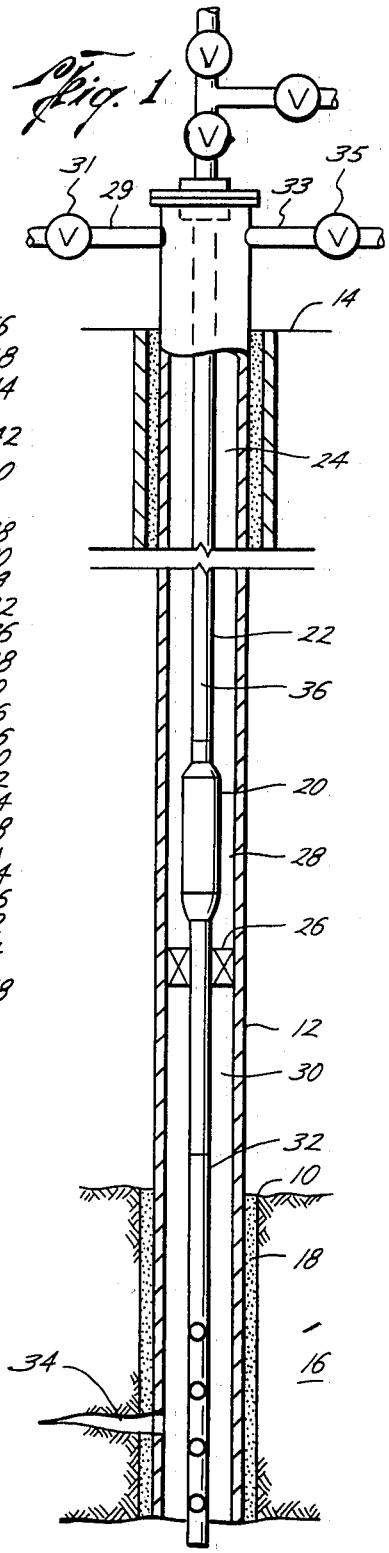
FIG. 1 is a fragmentary, part cross-sectional view of a producing well having apparatus made in accordance with the present invention.

Referring initially to FIG. 1, there is illustrated a typical oil or gas well during the production stage showing the environment of the present invention. The well includes a borehole 10 having a casing 12 extending downwardly from the surface 14 to a payzone 16. The casing 12 is cemented into the borehole 10 as shown at 18.

A production tubing 22 with a downhole relief valve 20, packer 26 and perforated nipple 32 disposed thereon extends from surface 14 down through casing annulus 24 of cased borehole 10. Casing annulus 24 is formed by production tubing 22 and casing 12. Packer 26 is disposed about production tubing 22 above formation 16 and sealingly engages casing 12 to form upper casing annulus 28 and lower casing annulus 30. The downhole relief valve 20 is connected in series with production tubing 22 above packer 26. Perforated nipple 32 is attached to the lower end of production tubing 22 adjacent payzone 16 to provide communication between the lower casing annulus 30 and the production tubing 22. For completing and producing the well, the casing 12 is perforated to provide a plurality of perforations at its lower end as at 34 to provide communication between the payzone 16 and the lower casing annulus 30. Hydrocarbons from the payzone 16 flow through the perforations 34, the lower casing annulus 30 and the perforated nipple 32 and into the flow bore 36 of the production tubing 22, up through the downhole relief valve 20, and continue to flow to the surface 14.

To maintain control of the well, the upper casing annulus 28 is filled with well fluids, such as drilling mud, creating a static head pressure at the bottom of the upper casing annulus 28 near the packer 26. The static head pressure is greater than the formation pressure by utilizing fluids of appropriate density. Thus, the static head pressure controls the well and prevents leakage around packer 26 and into the upper casing annulus 28. Upper casing annulus 28 is connected at its upper end to a pumping stations via line 29 and valve 31 so that additional drilling mud may be pumped or additional drilling fluid pressure may be applied in upper casing annulus 28 if required. Upper casing annulus 28 is also connected at its upper end to a relief line 33 and a casing annulus relief valve 35 of the type disclosed on page 1646 in the aforementioned *Composite Catalog of Oil Field Equipment*. Relief valve 35 is preset at a certain pressure to relieve the pressure in upper casing annulus 28 where it exceeds such preset pressure.

Figure 2:
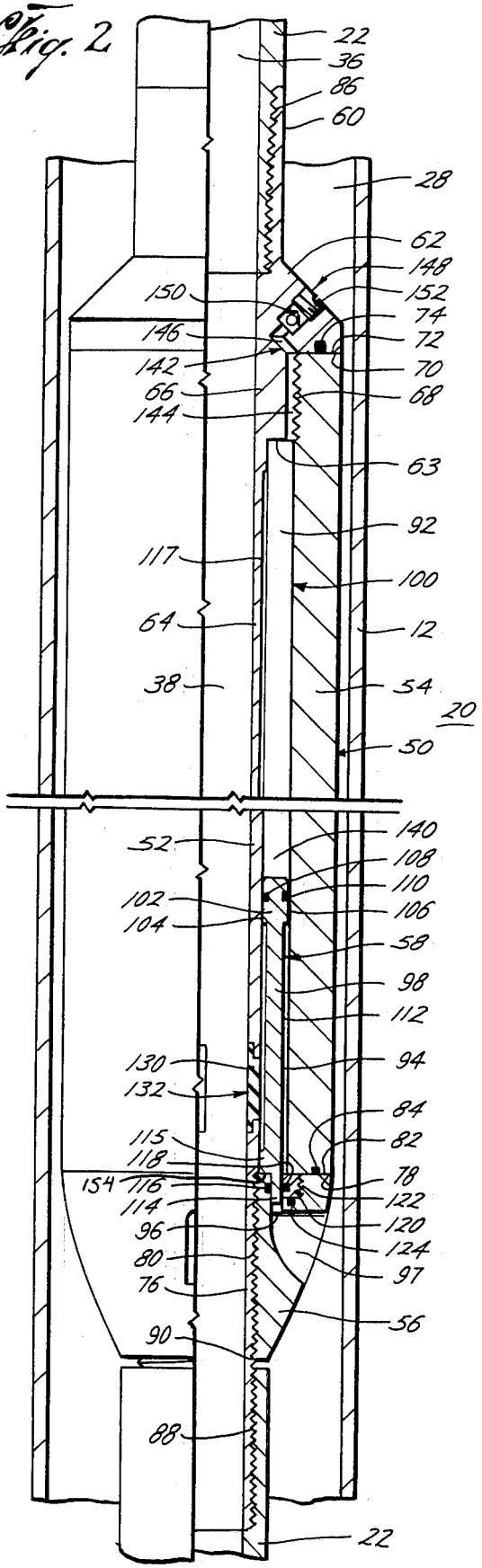
FIG. 2 is a cross-sectional view of the downhole relief valve of FIG. 1 in the closed position and disposed downhole.

Referring now to FIG. 2, there is shown the downhole relief valve 20 series connected with production tubing 22 and disposed within casing 12 above packer 26 (not shown in FIG. 2). The external surface of valve 20 is disposed in upper casing annulus 28 and is exposed to the static head pressure of the well fluids in upper casing annulus 28. Valve 20 includes a flow passage 38 coaxial with and having the same interior diameter as the flowbore 36 of production tubing 22. Thus valve 20 does not restrict the flow of hydrocarbons through flowbore 36.

The downhole relief valve 20 includes a valve body 50, formed by an inner tubular mandrel 52, an outer tubular barrel 54, and a connector member 56. Inner mandrel 52 includes an upper box end 60, a radially projecting and conically shaped annular shoulder 62, and a lower downwardly extending cylindrical portion 64. Annular shoulder 62 has an outer diameter smaller than the inner diameter of casing 12 and includes a threaded reduced diameter portion 66. Barrel 54 telescopingly receives cylindrical portion 64 and includes interior threads at its upper end for threaded engagement at 68 with the exterior threads of reduced diameter portion 66. Reduced diameter portion 66 creates a downwardly facing annular surface 70 which abuts the upper end 72 of barrel 54 in the made-up position. Surface 70 includes an annular groove having an O-ring 74 therein for sealingly engaging the upper end of barrel 54 for preventing fluid flow between surface 70 and the upper end 72.

The lower portion 76 of cylinder portion 64 projects below the lower end 78 of barrel 54 and is threaded at 80 for threadingly receiving connector member 56. The upwardly facing surface 82 of connector member 56 abuts the lower end 78 of barrel 54 to capture barrel 54 between surface 70 and connector member 56. An annular groove with O-ring 84 disposed therein, is disposed in lower end 78 of barrel 54 for sealing engagement with connector member 56.

Rotary shouldered connections 86, 88 are provided on upper box end 60 and lower pin end 90 of cylindrical portion 64 for threaded connection with the respective pin and box ends of production tubing 22.

The outer diameter of cylindrical portion 64 of inner mandrel 52 is smaller than the inner diameter of outer barrel 54 so as to form an annular chamber 100 therebetween. The upper end 92 of annular chamber 100 is formed by the downwardly facing side 63 of annular shoulder 62 of inner mandrel 52 and the lower end 94 of annular chamber 100 is formed by upwardly facing surface 82 of connector member 56.

Connector member 56 includes an annular slot 96 in the lower end 94 of chamber 100 through surface 82 and apertures or ports 97 extending from annular slot 96 to the exterior of connector member 56 to provide fluid communication between chamber 100 and upper casing annulus 28.

A reciprocable piston 58 with a tubular body 98 is dimensioned to be slidingly received within annular chamber 100. Piston 58 includes an upper annular head 102 having inner and outer diameter surfaces 104, 106 which slidingly engage the exterior of cylindrical portion 64 of mandrel 52 and the interior of outer barrel 54, respectively. Inner and outer diameter surfaces 104, 106 each have annular grooves housing O-rings 108, 110, respectively, for sealingly engaging inner mandrel 52 and outer barrel 54.

The remaining portion 112 of the exterior surface of piston 58 is reduced in diameter from annular head 102 to reduce sliding friction with the interior of barrel 54. Similarly, the interior surface of piston 58 has a substantial portion thereof enlarged in diameter to reduce contact with the exterior of inner mandrel 52. An inwardly projecting annular shoulder 115 is provided on the lower end of piston 58 to slidingly engage inner mandrel 64 and thereby stabilize piston 58 during reciprocation.

Piston 58 also includes at its lower end an annular tongue 114 projecting downwardly into annular slot 96 in connector member 56. Annular tongue 114 forms a shoulder on the lower end 154 of piston 58 which abuts upwardly facing surface 82 of connector member 56 thereby inhibiting further downward displacement of piston 58. The annular walls of member 56 forming slot 96 include annular inner and outer grooves housing O-rings 116, 118 for sealingly engaging each side of annular tongue 114. For assembly purposes, the outer wall of slot 96 is disposed on an annular insert 120 threaded into an annular bore 122 in connector number 56. The bottom of bore 122 also includes an annular groove housing an O-ring 124 for sealing with the bottom of insert 120.

Ports 130 are provided in the cylindrical portion 64 of inner mandrel 52 for fluid communication between the flow passage 38 of mandrel 52 and annular chamber 100. Ports 130 are located just above the threads 80 on the lower portion of cylindrical portion 64 and adjacent the enlarged interior surface of annular piston 58 when piston tongue 114 is received in annular slot 96. Ports 130 must be disposed below the O-ring seals 108 in piston head 102. Initially ports 130 may be closed by plugs 132 which are press fitted into ports 130 to prevent debris from accumulating in annular chamber 100. The plugs have an enlarged head with curved edges toward flow passage 38 to provide a better fit and support and to prevent leakage of fluid and plug displacement toward annular chamber 100. The flowbore pressure of the production tubing is substantially greater than the pressure in the enlarged interior surface of piston 58 thus tending to maintain plugs 132 in position within ports 130.

A reduced diameter portion or annular relief groove 117 is provided in the exterior surface of cylindrical portion 64 of mandrel 52 and above piston head 102 when piston 58 is in its lower position. When piston 58 moves upwards and after lower end 154 of piston 58 clears ports 130, O-ring 108 sealingly disengages with the exterior of mandrel 52 upon head 102 moving upwardly adjacent relief groove 117. It is preferred that plugs 132 are blown out of ports 130 prior to the disengagement of O-ring 108 with mandrel 52.

Biasing means 140, such as a compressed gas, above piston 58 in chamber 100 is provided to maintain piston 58 in its lower normal position. A gas passageway 142 is provided through annular shoulder 62 to fill that portion of chamber 100 above piston 58 with a compressed gas such as nitrogen. Passageway 142 includes a fill groove 144 and inner and outer fill ports 146, 148 extending from chamber 100 to the exterior of annular shoulder 62. Outer fill port 148 includes an enlarged threaded bore for receiving a check valve 150. Valve 150 is a one-way valve permitting the inlet of pressurized gas but preventing the escape of such gas from chamber 100. Once chamber 100 has been filled with gas, a seal plug 152 is threaded into the threaded bore to seal off check valve 150.

In the normal position, i.e. in this case the closed position where ports 130 are closed, piston 58 is positioned at the lower end of annular chamber 100 as shown in FIG. 2. In the closed position, the stop shoulder of piston 58 engages upwardly facing surface 82 of connector member 56. The head 102 of piston 58 is positioned between that section of inner mandrel 52 below relief groove 117 and outer tubular barrel 54. The annular tongue 114 of piston 58 is received in annular slot 96 exposing the horizontal cross-sectional area of tongue 114 to the fluid pressure in upper casing annulus 28 via ports 97. The compressed nitrogen gas above piston 58 in chamber 100 applies pressure to the horizontal cross-sectional area of upper annular head 102 of annular piston 58. The required pressure of the nitrogen gas in the upper portion of annular chamber 100 is chosen considering the length of annular chamber 100, the downhole temperature, and the difference in horizontal cross-sectional areas of piston 58, i.e. the upper end of upper head 102 exposed to the nitrogen and the lower end of tongue 114 in fluid communication with the upper casing annulus 28. The nitrogen pressure in chamber 100 is great enough to provide a margin of safety above the normal static head pressure in the upper casing annulus 28 to insure that piston 58 is held in the closed position and downhole relief valve 20 does not activate prematurely.

Compressed gas 140 is tightly sealed in the upper end 92 of annular chamber 100 to prevent any gas escape to the surrounding areas. Seals 108 and 110 prevent gas leakage around upper annular head 102 of piston 58 towards the lower end of chamber 100. Check valve 150 prevents gas escape to the annulus via outer fill port 148. Furthermore, O-ring seal 74 prevents gas leakage to the annulus between connecting surface 70 of annular shoulder 62 and upper end 72 of barrel 54.

Fluid from annulus 28 is prevented from leaking into downhole relief valve 20 while piston 58 is in the normal position. O-ring seals 116 and 118 prevent annulus fluid from entering annular chamber 100 around tongue 114. Seal 124 prevents the leakage of such fluids from upper casing annulus 28 to chamber 100 through annular bore 122. Seal 84 prevents similar leakage through the connecting surface where upwardly facing surface 82 of connector member 56 abuts the lower end 78 of barrel 54. Also, seal 74 prevents annulus fluid from entering chamber 100 between downwardly facing annular surface 70 and upper end 72 of barrel 54. Finally seal plug 152 seals off casing annulus fluid in outer fill port 148.

Under normal production conditions, the static head pressure of upper casing annulus 28 at the depth of the downhole relief valve 20 exerts a force on the lower end of tongue 114 of piston 58 which is less than the force exerted by biasing means 140 on the upper end of piston 58. Therefore the annular piston 58 remains in the closed position.

Should the hydraulic pressure on tongue 114 cause a force on piston 58 which is greater than the force applied to the upper end of piston 58 by biasing means 140, piston 58 will move upwardly to the open position. As piston 58 moves upwardly, tongue 114 disengages O-rings 116, 118 and its lower end clears surface 82 of connector member 56. When the lower end of tongue 114 clears surface 82, the pressure in upper casing annulus 28 is applied to the entire bottom cross-section area of piston 58 resulting in a sudden and significant increase to the force displacing piston 58 upwardly. The piston displacement is therefore accelerated as the force differential against biasing means 140 in annular chamber 100 is significantly increased thereby completely exposing ports 130 and causing plugs 132 to be blown out of ports 130. After lower end 154 of piston 58 clears ports 130 entirely, upper head 102 of piston 58 reaches annular relief groove 117 of the exterior surface of cylindrical piston 64 and O-ring 108 sealingly disengages with the exterior of mandrel 52. This allows the gas from the upper end 92 of chamber 100 to escape around piston head 102 and to avoid pressure lock.

The annulus fluid exerting pressure on piston 58 follows the displaced piston and enters the empty space in chamber 100 created by the displacement. Therefore, fluid from the upper casing annulus 28 in fluid communication with the lower end of tongue 114 via ports 97 follows the displaced piston through annular slot 96 and into the empty space in the lower end of annular chamber 100 and the outside groove of piston 58 when the lower end of tongue 114 clears surface 82. When piston 58 is displaced to the point where ports 130 are exposed, the annular fluid exerts pressure on plugs 132 and blows them out of ports 130 thereby opening ports 130 and permitting annulus fluid to flow into flowbore 36. In this manner a continuous flow passage of annulus fluid from upper casing annulus 28 to flowbore 36 is created via ports 97, annular slot 96, the lower end of annulus chamber 100 and ports 130.

The various pieces of downhole relief valve 20 are assembled before downhole relief valve is attached to tubing string 22. Such assembly is simple due to the fact that valve 20 includes a number of pieces constructed to accommodate a relatively simple assembly without adversely affecting the operability and reliability of valve 20. Before the assembly is commenced, all the areas exposed to piston movements and all the sealing areas are treated with appropriate lubricants to facilitate the reciprocation of piston 58 and the sealing requirements. Following such lubrication, plugs 132 are press fitted by appropriate tools into ports 130. Barrel 54 then telescopically receives cylindrical portion 64 of mandrel 52. Interior threads of barrel 54 engage exterior threads of reduced portion 66 of mandrel 52 for a rotational connection until surface 70 tightly abuts surface 72. Piston 58 is inserted into annular chamber 100. Connector piece 56 is then assembled. Insert 120 with O-ring seal 116 in place is threaded into bore 122. The assembled connector piece 56 is rotationally connected by a threaded engagement to the lower portion 76 of mandrel 52 until surface 78 of barrel 54 tightly abuts surface 82 of connector piece 56. During this connecting step, tongue 114 or a portion of it is received in annular slot 96. Following, valve 150, such as a Dill valve, is inserted into the threaded bore of outer fill port 148. Pressurized gas, such as nitrogen, is introduced into upper section 92 of annular chamber 100 via valve 150 inner fill port 146 and fill groove 144. The gas is pressurized to the required pressure. During the introduction of the pressurized gas, piston 58, if necessary, moves downwardly until lower end 154 abuts upwardly facing surface 82 of connector member 56. Once chamber 100 is charged with gas to the required pressure, downhole relief device 20 is checked for gas leakage around any of the sealed surfaces. If no leakage is present, seal plug 152 is screwed into the threaded bore of outer fill port 148 to seal off valve 150.

In operation, the assembled and pressurized downhole relief valve 20 with piston 58 in the closed position is series connected to production tubing 22 and lowered into the well as shown in FIG. 2.

In a producing gas well, the flowbore pressure, caused by the pressure of payzone 16, gradually decreases as the gas flows upwardly through flowbore 36 to the surface 14 due to frictional losses. However, such pressure decrease is considerably lower than the static head pressure decrease in upper casing annulus 28 which varies with the height of the drilling mud at any given depth in the annulus. Consequently, the static head pressure in the upper portion of upper casing annulus 28 is substantially lower than the pressure in production tubing flow bore 36 at any given point in the upper portion of the production tubing 22, particularly as compared to the static head pressure in the lower portions of upper casing annulus 28 which is greater than the formation pressure in production tubing flow bore 36. The static head pressure in the upper casing annulus 28 increases with the depth in the annulus and consequently a transition point is reached along the length of production tubing 22 where the pressure in the production tubing flow bore 36 is the same as the static head pressure in the upper casing annulus 28. Below this point, the static head pressure in upper casing annulus 28 exceeds the pressure in production tubing flow bore 36. Thus, the pressure differential towards upper casing annulus 28 is at its greatest near the surface 14, and the pressure differential toward production tubing flow bore 36 is at its greatest near packer 26.

In a producing oil well, the flowbore pressure, caused by the pressure of payzone 16, decreases as the oil flows upwardly due to the static head pressure created by the oil in flowbore 36 and the frictional losses in production tubing 22. Such flowbore pressure decrease is greater than the flowbore pressure decrease in a producing gas well. Further, the decrease in an oil well occurs faster than that of a gas well. However, such flowbore pressure decrease as the oil flows upwardly is lower than the static head pressure decrease in upper casing annulus 28 which varies with the height of the drilling mud because, in general, the drilling mud has a higher density than that of the oil produced. Consequently, the static head pressure in the upper portion of upper casing annulus 28 is lower than the pressure in production tubing flowbore 36 at any given point in the upper portion of production tubing 22 as in the case of a producing gas well.

If production tubing 22 ruptures below the transition point where there is a pressure differential towards production tubing flowbore 36, drilling mud from upper casing annulus 28 will tend to flow through the rupture into production tubing flowbore 36 thus there will be no pressure increase in the annulus. However, if such rupture in tubing 22 occurs above the transition point where there is a pressure differential towards upper casing annulus 28, hydrocarbons from production tubing flowbore 36 will flow through the rupture into upper casing annulus 28. This displacement of pressure increases the pressure throughout upper casing annulus 28. If this increase in pressure is not relieved, casing 12 will rupture if casing 12 is not strong enough to withstand these higher pressures.

Figure 3:
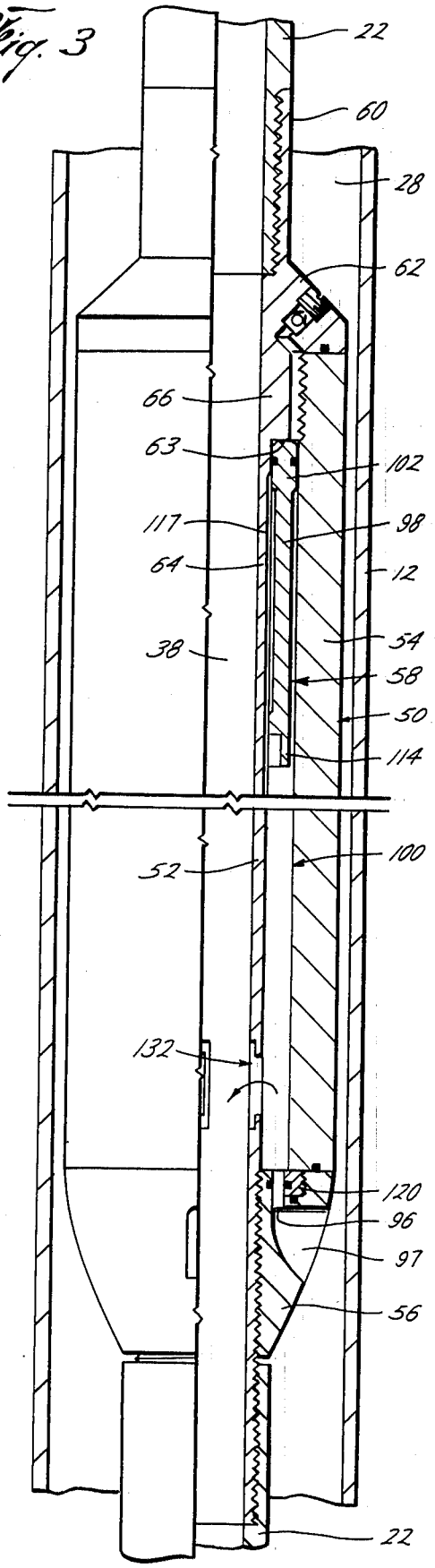
FIG. 3 is a cross-sectional view of the downhole relief valve of FIG. 2 in the open position following a tubing rupture.

Downhole relief valve 20 is designed to kill the well when a predetermined pressure increase occurs in upper casing annulus 28 thereby preventing rupture of casing 12 or a well blowout. Therefore, when production tubing 22 ruptures above the transition point and the leaking hydrocarbons add pressure to the static head, the force exerted by upper casing annulus 28 on the lower end of tongue 114 of piston 58 increases. Once this force overcomes the predetermined force exerted by biasing means 140 on the upper end of piston 58, piston 58 reciprocates upwardly in annular chamber 100. When the lower end of tongue 114 clears surface 82, the upper casing annulus pressure is applied to the entire lower cross-section of piston 58. Therefore, the upward force on piston 58 increases significantly and its upward displacement becomes rapid and large enough to completely expose ports 130 to the annulus pressure. The annulus pressure then blows out plugs 132 and opens ports 130 whereby drilling mud from upper casing annulus 28 flows through ports 97, annular slot 96, the lower end of chamber 100, ports 130, and into production tubing flowbore 36. After lower end 154 of piston 58 clears ports 130 entirely, O-ring 108 reaches annular relief groove 117 in the exterior surface of cylindrical portion 64 and disengages with the exterior of mandrel 52 allowing the compressed gas 140 from upper end 92 of chamber 100 to escape around piston head 102 and to prevent a pressure lock. FIG. 3 shows downhole relief valve 20 in the open position following a tubing rupture. The fluid that flows into flowbore 36 creates a static head pressure which upon flow of adequate fluid into flowbore 36, exceeds the payzone pressure and thus kills the well. The fluid flow continues until the static head pressure in production tubing flow bore 36 equalizes with the static head pressure in upper casing annulus 28. If the annulus fluid is not enough to kill the well, additional fluid is pumped in via line 29 and valve 31.

After the well is placed under control, the ruptured production tubing is removed for repair. After repair, downhole relief valve 20 is reset and the production string may be lowered back into the well to resume service.

In addition to the automatic activation of downhole relief valve 20 caused by the pressure increase in upper casing annulus 28 due to the tubing rupture, downhole relief valve 20 may be activated manually from the surface or from a location away from the well without a tubing rupture. The manual activation is accomplished by opening valve 31 and by applying an additional pressure from a pumping station via line 29 thereby increasing the static head pressure throughout upper casing annulus 28. When the pressure increase reaches a predetermined amount exerting a force on the lower end of tongue 114 of piston that overcomes the force exerted by biasing means 140, piston 58 reciprocates upwardly and exposes ports 130 to upper casing annulus 28 fluids whereby the well is killed as previously described. This procedure may be particularly applicable to an underwater environment in case a christmas tree at the mud line, for example, was broken off and it was desirable to kill the well by activating manually the downhole relief device.

Casing annulus relief valve 35 is preset to respond to a pressure which is higher than the pressure activating downhole relief valve 20. Its preset pressure is determined by the design characteristics of the particular casing. If because of a malfunction of the downhole relief valve 20 or any other reasons the pressure in the upper end of upper casing annulus 28 exceeds the casing annulus relief valve 35 preset pressure, valve 35 will open to relieve the upper casing annulus from the increased pressure.

Figure 4:
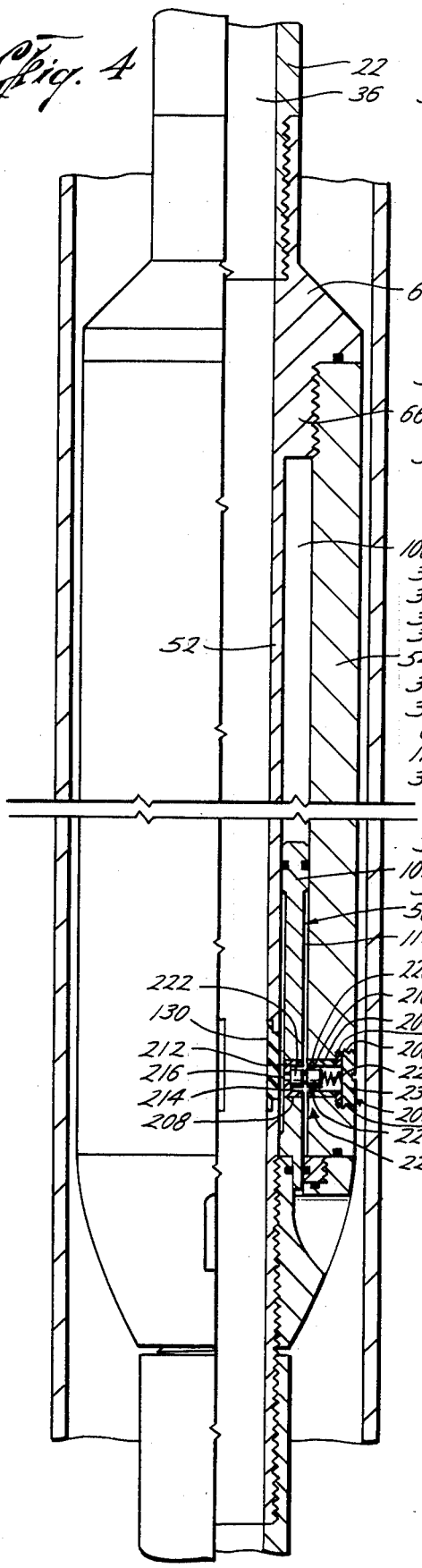
FIG. 4 is a cross-sectional view of another embodiment of the downhole relief valve of FIG. 1.

FIG. 4 shows another embodiment of the present invention. The embodiment of FIG. 4 is similar to that of FIG. 2 with the principal difference being that a shear pin, rather than compressed gas, is used as the biasing means to maintain piston 58 in its lower position.

Outer tubular barrel 54 has a circular, threaded barrel bore 202 located at approximately the level of ports 130 and extending from the exterior annular surface to the interior annular surface of barrel 54. Bore 202 comprises interior section 204 and exterior section 206 with interior section 204 having a smaller diameter than exterior section 206. Piston 58 also has a circular threaded piston bore 208 which has the same diameter as interior section 204 of barrel bore 202. Piston bore 208 extends from the exterior surface to the interior surface of piston 58 and is radially in line with barrel bore 202 when piston 58 is in the usual position at the lower end of annular chamber 100 as shown in FIG. 4. A hollow cylindrical shear pin holder 210 is screwed into the threaded interior section 204 of barrel bore 202 covering the entire interior cylindrical surface of interior section 204. A hollow cylindrical shear pin socket 212 with an inside diameter equal to the inside diameter of shear pin holder 210 is screwed into piston bore 208 covering the entire interior cylindrical surface of piston bore 208. The interior end of shear pin socket 212 is closed by socket wall 214 having a bore 216.

Shear pin 220 comprises three cylindrical sections, namely, shear pin piston section 222, shear pin barrel section 224, and shear section 226. Shear pin piston section 222 has a diameter and length sized to fit inside shear pin socket 212 without any part of it extending beyond the exterior surface of piston 58 when shear pin 220 is in place. Shear pin barrel section 224 has a diameter to fit inside shear pin holder 210 but a length shorter than that of the length of shear pin holder 210. Shear section 226 connects shear pin barrel section 224 to shear pin piston section 222. Shear section 222 has a diameter which is smaller than that of the other two sections and is sized according to the shearing resistance required for the particular shear pin. The length of shear section 226 is approximately equal to the distance between the exterior surface of portion 112 of piston 58 and the interior surface of barrel 54.

With piston 54 being in the normal position, shear pin 220 is received by the radially aligned shear pin socket 212 and shear pin holder 210. It is retained therein by spring 228 and plug 230 that has a nylon insert. Plug 230 is screwed in exterior section 206 to close the communication between the interior and the exterior of barrel 54. Plug 230 also provides a seat for spring 228 so that spring 228 biases shear pin 220 to its normal position as shown in FIG. 4. Socket wall 214 provides a seat for shear pin 220 when it is received in pin socket 212. Because of the dimensions of the various sections of shear pin 220, shear pin 220 is aligned in a manner that shear pin piston section 222 and shear pin barrel section 224 do not extend beyond shear pin socket 212 and shear pin holder 210, respectively. A gasket 232, placed on the exterior end of shear pin holder 210 and extending to the mouth of interior bore section 204 and an O-ring seal 234 placed in an annular groove of plug 230, prevent any fluid leakage through bore 202.

The embodiment of FIG. 4 is used and operated in a similar fashion as the embodiment of FIG. 2 with the only differences arising from the change in the biasing means 140. Piston 58 is kept to the normal i.e. closed position shown in FIG. 4, by shear pin 220. Shear pin 220 is designed to withstand a certain predetermined pressure exerted on the lower end of tongue 114 of piston 58 by the fluids in upper casing annulus 28. The downhole annulus pressure varies from well to well and therefore, in the embodiment of FIG. 4, shear pins with different shear resistances may be used in different wells. As long as the pressure of upper casing annulus 28 remains below a certain predetermined amount, shear pin 220 maintains piston 58 in the closed position and prevents upper casing annulus 28 fluid from flowing into flowbore 36. If due to tubing rupture above the transition point, upper casing annulus 28 pressure increases and the force exerted on the lower end of tongue 114 exceeds the designed shear strength of shear pin 220, shear pin 220 shears. Consequently, in the absence of any biasing force, piston 58 is displaced immediately to the upper section of annular chamber 100, completely exposing ports 130 to the upper casing annulus pressure.

In a manner similar to that described for the embodiment of FIG. 2, the annulus pressure then blows out plugs 132 and opens ports 130 whereby drilling mud from upper casing annulus 28 flows into production tubing 22 and kills the well.

Figure 5:
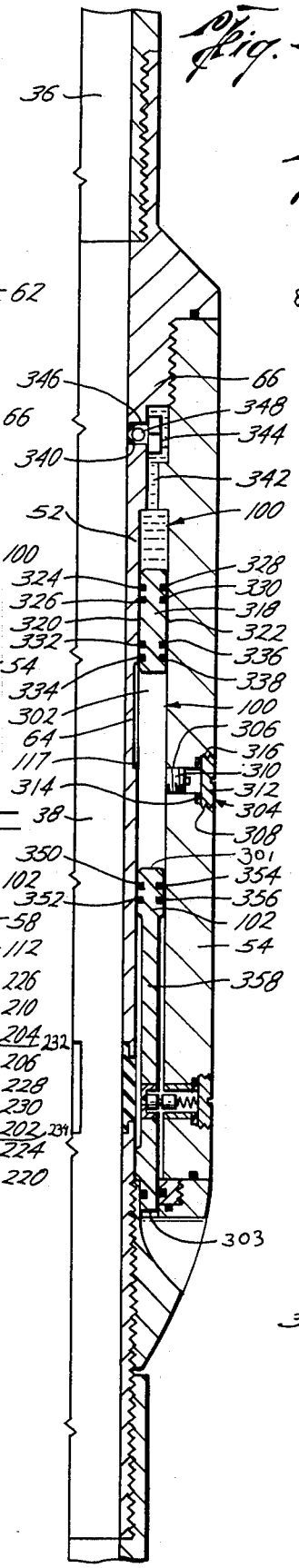
FIG. 5 is a cross-sectional view of another embodiment of the downhole relief valve shown in FIG. 4.

Referring now to FIG. 5, another embodiment of the present invention is shown that utilizes an equalization piston whereby the valve opens when a predetermined net increase in the pressure occurs rather than when an absolute pressure is reached in the annulus. The shear force is provided by the net pressure increase and not by the absolute pressure in the upper casing annulus 28. Therefore, a standard shear pin with a predetermined shear strength may be used in a plurality of valve applications regardless of the downhole annulus pressure of an individual well.

The embodiment of FIG. 5 is similar to the embodiment of FIG. 4 with the principal difference arising out of the utilization of an equalization piston. Because of the similarity between the two embodiments, the same numbers are used in FIG. 5 as were used in FIG. 4 for similar parts.

Piston 358 is similar to piston 58 of the embodiment of FIG. 4 with the exception that in the embodiment of FIG. 5, the cross-sectional area of the upper end of annular surface 301 of piston 358, exposed to the pressure of chamber 100 is equal to the cross-sectional area of lower end annular surface 303 of piston 358 exposed to the pressure of upper borehole annulus 28. It is essential that surfaces 301, 303 are equal in cross-section for reasons that will become obvious below. Although FIG. 5 is not to scale, the two aforementioned surfaces, upper end annular surface 301 and lower end annulus surface 303, are equal in cross-sectional area.

There are two biasing means biasing piston 358 to the normal i.e. closed position. The first is biasing means 302 which is provided by compressed gas above piston 358 in chamber 100. A gas passageway 304 is provided through barrel 54 at a point just above piston head 102. Passageway 304 includes inner and outer ports 306, 308, respectively, extending from the interior to the exterior surface of barrel 54. Inner port 306 includes a threaded bore for receiving a valve such as Dill valve 310. Outer port 308 includes a threaded bore for receiving a seal plug 312. A gasket 314 covering the mouth of inner port 306 and an O-ring seal 316 placed in an annular groove of plug 312 provides the sealing for passageway 304. The second biasing means holding piston 358 in the normal position is shear pin 220 which is similar to shear pin 220 of the embodiment of FIG. 4.

A sliding equalization piston 318, placed in the upper end of chamber 100 above piston 358, provides a movable upper boundary for the compressed gas of biasing means 302. Equalization piston 318 has inner and outer diameter surfaces 320, 322 which slidingly engage the exterior of cylindrical portion 64 of mandrel 52 and the interior of outer barrel 54, respectively. Inner and outer diameter surfaces 320, 322 each have annular grooves housing O-rings 324, 326 and 328, 330, respectively, towards the upper end and 332, 334 and 336, 338 respectively towards the lower end of piston 318 for sealingly engaging cylindrical portion 64 and outer barrel 54.

A radial fluid passageway 340 is provided through portion 66 of inner mandrel 52 to permit the flow of fluids from production tubing flowbore 36 to that portion of chamber 100 above piston 318. Passageway 340 includes fill grooves 342, 344 and fill port 346 extending from chamber 100 to flow passage 38. Fill port 346 is threaded for receiving check valve 348.

Reduced diameter portion or annular relief groove 117 is provided in the exterior surface of cylindrical portion 64 of mandrel 52 above piston head 102 when piston 358 is in the lower position and below equalization piston 318. Upon the upward movement of piston 358 and upon the complete exposure of ports 130 in this upper casing annulus pressure, O-ring 350 sealingly disengages with the exterior of inner mandrel 52. Annular relief groove 117 does not extend upwards beyond a point where O-rings 334, 332 of piston 318 may disengage when piston 318 moves downwardly because such disengagement is not desirable.

Before the embodiment shown in FIG. 5 is lowered into the well and after piston 358 is placed into the lower position with shear pin 220 in place, that portion of chamber 100 between the lower end of equalization piston 318 and the upper end of piston 358 is filled with compressed gas through valve 310. The compression pressure is less than the expected downhole annulus static head pressure by a small amount. When the gas flows into the chamber via passageway 304, equalization piston 318 moves upwardly and engages the upper end of annular chamber 100. Once the chamber section has been filled with gas, seal plug 312 is threaded into the threaded bore 308 to prevent any leakage through passageway 304.

When the downhole relief device 20 of FIG. 5 is lowered into a well filled with fluids, these fluids enter into the production tubing flowbore 36, and through check valve 348, into chamber 100 via grooves 342, 344 and exert pressure on upper end of equalization piston 318. When downhole relief device 20 is lowered into its designated place adjacent payzone 16 and the downhole static head fluid pressure exceeds the pressure of the compressed gas which is between piston 318 and piston 358, piston 318 moves downwardly to compress the gas in chamber 100 further until the pressure of the gas between equalization piston 318 and piston 358 equals the normal downhole static head pressure in upper borehole annulus 28. When this occurs, biasing means 302 exerts pressure on upper end 301 of piston head 102 which equals the static head pressure of the fluids downhole in annulus 28. The well fluids in flowbore 36 are then removed to commence the production of the well with the pressure of biasing means 302 continuing to equal the downhole normal static head pressure initially encountered in upper borehole annulus 28. If the static head pressure increases and exceeds the compressed gas pressure of biasing means 302 by a certain predetermined amount, shear pin 220 shears and piston 358 gradually moves upwardly until piston head 102 reaches the annular relief groove 117 provided in the exterior surface of cylindrical portion 64 of mandrel 52. Then O-ring 350 sealingly disengages with the exterior of mandrel 52 and allows the gas of biasing means 302 to escape around piston head 102. Therefore, pressure lock is avoided and piston 358 is quickly displaced completely exposing ports 130. In a manner previously described with respect to the other embodiments, annular fluids then flow into flowbore 36 and kill the well.

While preferred embodiments of the present invention have been shown and described, modifications thereof can be made by one skilled in the art without departing from the spirit of the invention. For example, while the seals used in the preferred embodiments described are O-ring seals, other elastomeric seals such as lip seals may be used instead of O-ring seals without affecting the operation of the invention.

What is claimed is:

1. A well apparatus adapted for connection in series with a pipe string, the pipe string extending into a producing well and forming a casing annulus with the casing and having a flow passage therethrough for the flow of hydrocarbons through the pipe string to the surface, comprising:

a tubular member having connection means at each end for connection in series with the pipe string, said member having an outer barrel and an inner mandrel forming a chamber therebetween and having fluid communication means providing fluid communication through said barrel and mandrel and between the casing annulus and the flow passage;

said inner mandrel having an internal flow bore having a common inner diameter with the flow passage through the pipe string and being coaxial with the flow passage so as to become a part of the flow passage;

said barrel having an outer surface exposed to the well fluids in the casing annulus;

said chamber circumscribing the flow passage for the hydrocarbons;

barrier means for closing and opening said fluid communication means;

said barrier means responsive to an increase in the pressure in the casing annulus for opening said fluid communication means and allowing well fluids from the casing annulus to flow through said barrel and mandrel and into the flow passage to control the well.

2. The well apparatus according to claim 1 wherein said fluid communication means forms a channel including flow ports in said barrel and mandrel for providing fluid flow between the flow passage and the casing annulus; said channel bypassing a portion of said chamber.

3. The well apparatus according to claim 2 further comprising displaceable plugs disposed in said flow port in said mandrel.

4. The well apparatus according to claim 1 wherein said barrier means comprises a sliding piston for closing said fluid communication means in one position and opening said fluid communication means in another position and said fluid communication means includes a channel through said barrel and mandrel.

5. The well apparatus according to claim 4 further comprising means for biasing said piston to said one position.

6. The well apparatus according to claim 4 wherein said outer barrel includes a connector member for connecting said outer barrel to said inner mandrel.

7. The well apparatus according to claim 4 wherein said piston has a first portion exposed to the fluids in the casing annulus.

8. The well apparatus according to claim 7 further including means responsive to the fluids from the casing annulus, the fluids exerting a hydraulic force on said first portion biasing said piston towards the open position.

9. The well apparatus according to claim 8 wherein said barrel includes a slot for receiving said first portion of said piston.

10. The well apparatus according to claim 9 further including a cylindrical insert adjacent said slot, said insert forming part of said slot and having sealing means for sealingly engaging said piston.

11. The well apparatus according to claim 4 further including means for biasing said piston to said closed position.

12. The well apparatus according to claim 11 wherein said biasing means includes a shear pin maintaining said piston in said closed position.

13. The well apparatus according to claim 12 wherein said shear pin includes a reduced diameter shear portion.

14. The well apparatus according to claim 11 wherein said biasing means includes compressed gas exerting a biasing force on a second portion of said piston.

15. The well apparatus according to claim 14 wherein said compressed gas is nitrogen.

16. The well apparatus according to claim 14 wherein said first portion has a smaller cross-sectional area than that of said second portion.

17. The well apparatus according to claim 16 wherein said piston comprises:

a piston head, said piston head having one end exposed to said compressed gas, means disposed on said piston for sealingly engaging said barrel and mandrel;

a medial portion having a smaller thickness than said head and being out of contact with said barrel and mandrel;

an annular tongue extending below said medial portion, said tongue having a smaller annular thickness than said medial portion; and means for sealing said tongue with said barrel when said piston is in said closed position.

18. The well apparatus according to claim 14 further comprising relief means for relieving said compressed gas while said piston is moving from said closed position to said open position.

19. The well apparatus according to claim 18 wherein said relief means includes a longitudinal relief groove on said mandrel, said groove providing a bypass around said piston when said piston is displaced a predetermined distance towards said relief groove.

20. The well apparatus according to claim 1 wherein said barrier means includes means responsive to an increased hydraulic force from the casing annulus.

21. A well apparatus connected in series with a pipe string, the pipe string extending into a producing well and forming a casing annulus with the casing and a flow passage for the flow of hydrocarbons to the surface, comprising:

an outer barrel;

an inner mandrel being received in the interior of said barrel, said barrel and mandrel forming a chamber therebetween and a channel through the mandrel and the barrel, the channel providing fluid communication between the flow passage and the casing annulus;

a piston mounted within said chamber for reciprocating between an open position to allow fluid flow through said channel and between the flow passage and casing annulus and a closed position to prevent fluid flow through said channel, said piston having a first portion exposed to the fluids in the casing annulus biasing said piston towards said open position;

a shear pin holding said piston to said closed position;

compressed gas disposed in said chamber exerting a force on a second portion of said piston, said second portion having a surface area exposed to the pressure of said compressed gas which is equal to the surface area of said first portion which is exposed to the fluids in the casing annulus;

means for compressing said compressed gas to an equalization pressure equal to the annulus static head pressure that is present when the apparatus is lowered downhole;

means for maintaining constant said equalization pressure following compression of said compressed gas to the annulus static head.

22. A well apparatus according to claim 21 wherein said means for compressing said gas includes a slidingly movable equalization piston having one end exposed to a pressure equal to the annulus static head pressure.

23. A method for controlling a producing well having production tubing and casing extending downwardly therein and a packer sealing the annulus formed by the tubing and the casing, comprising the steps of:

series connecting a relief valve in the production tubing adjacent and above the packer;

closing a fluid passage in the relief valve extending between the flowbore of the tubing and the annulus;

running in the well the relief valve and the production tubing concurrently;

passing hydrocarbons through the relief valve and up the production tubing to the surface;

increasing the static head pressure in the annulus;

activating the relief valve;

increasing the magnitude of the hydraulic force exerted on the valve following activation of the valve;

opening said fluid passage;

flowing drilling fluids from the annulus into the flowbore of the tubing;

forming a flowbore static head pressure which is higher than the formation pressure thereby killing the well.

24. A method for controlling a well comprising the steps of:

closing flow ports extending between the flowbore of production tubing and the exterior thereof with a reciprocable piston;

biasing the piston in the closed position;

running the production tubing downhole to form a casing annulus;

increasing the fluid pressure in the casing annulus;

applying the increased casing annulus fluid pressure to the piston;

moving the piston away from the closed position;

increasing the magnitude of the force exerted on the piston;

opening the flow ports by moving the piston; and flowing well fluids from the casing annulus into the production tubing flowbore.

25. A well apparatus disposed in a cased borehole for preventing the blowout of a producing well comprising:

a pipe string extending into the borehole, said pipe string having a flow passage therethrough for the flow of hydrocarbons from the producing well and forming a casing annulus with the cased borehole;

a downhole relief valve having connecting means on each end for connection in series with said pipe string and having an internal flow bore having a common inner diameter and being coaxial with the flow passage through the pipe string for the flow of hydrocarbons therethrough;

a packer disposed on said pipe string below said relief valve dividing said casing annulus into an upper annulus and a lower annulus;

means responsive to an increase in annulus pressure for opening said downhole relief valve to provide fluid communication between the upper annulus and the flow passage of said pipe string whereby well fluids from the annulus are allowed to flow into the flow passage and control the well.

26. A well apparatus connected in series with a pipe string, the pipe string extending into a producing well and forming a casing annulus with the casing and a flow passage for the flow of hydrocarbons to the surface, comprising:

an inner mandrel;

a connector member being connected to one end of said inner mandrel;

a barrel being connected to said connector member and to another end of said inner mandrel;

said inner mandrel, connector body and barrel forming a chamber therebetween, said inner mandrel having a first port for providing fluid communication between the flow passage and the chamber, said connector member having a second port for providing fluid communication between the casing annulus and the chamber;

a piston mounted within the chamber for reciprocating between an opened position to allow fluid flow from the casing annulus to the flow passage through the second port, a portion of the chamber and the first port, and a closed position to prevent fluid flow from the casing annulus to the flow passage.

27. A well apparatus connected in series with a pipe string, the pipe string extending into a producing well and forming a casing annulus with the casing and a flow passage for the flow of hydrocarbons to the surface, comprising:

a valve body having a first port providing fluid communication between the casing annulus and the flow passage and a chamber adjacent the first port, the chamber being enclosed by said valve body and having only one end open for fluid communication between the chamber and the casing annulus and between the chamber and the first port;

a piston mounted within the chamber for reciprocating between an opened position to allow fluid flow through the first port and between the flow passage and the casing annulus and a closed position to prevent fluid flow through the first port and between the flow passage and the casing annulus;

said piston further closing the open end of the chamber when said piston is in the closed position to close fluid communication between the chamber and the first port, and between the chamber and the casing annulus.

* * * * *

UNITED STATES PATENT AND TRADEMARK OFFICE

CERTIFICATE OF CORRECTION

PATENT NO. : 4,576,235

DATED : MARCH 18, 1986

INVENTOR(S) : WILLIAM B. SLAUGHTER; HENRY C. HAYNIE

It is certified that error appears in the above—identified patent and that said Letters Patent is hereby corrected as shown below:

Column 5, line 27, change "stations" to ---station---.

Column 7, line 17, change "ports" to ---port---.

Column 13, line 62, after "130", delete "in" and insert ---to---.

Signed and Sealed this

*Eighth* Day of *July 1986*

[SEAL]

*Attest:*

DONALD J. QUIGG

*Attesting Officer*

*Commissioner of Patents and Trademarks*